US009975016B2

(12) United States Patent
Nakamura et al.

(10) Patent No.: US 9,975,016 B2
(45) Date of Patent: May 22, 2018

(54) GOLF CLUB HEAD

(71) Applicant: DUNLOP SPORTS CO. LTD., Kobe-shi, Hyogo (JP)

(72) Inventors: Takashi Nakamura, Kobe (JP); Takahiro Norimura, Kobe (JP); Naruhiro Mizutani, Kobe (JP); Daisuke Kohno, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days. days.

(21) Appl. No.: 15/385,267

(22) Filed: Dec. 20, 2016

(65) Prior Publication Data

US 2017/0173410 A1 Jun. 22, 2017

(30) Foreign Application Priority Data

Dec. 21, 2015 (JP) ..... 2015-248137

(51) Int. Cl.
*A63B 53/04* (2015.01)

(52) U.S. Cl.
CPC ..... *A63B 53/047* (2013.01); *A63B 53/04* (2013.01); *A63B 2053/0408* (2013.01); *A63B 2053/0416* (2013.01); *A63B 2053/0445* (2013.01)

(58) Field of Classification Search
USPC ..... 473/324–350
See application file for complete search history.

(56) References Cited

U.S. PATENT DOCUMENTS 1,289,553 A * 12/1918 Sanders ..... A63B 53/04 473/331
4,252,262 A * 2/1981 Igarashi ..... A63B 53/04 228/174
5,106,094 A * 4/1992 Desbiolles ..... A63B 53/04 473/342
5,713,800 A * 2/1998 Su ..... A63B 53/04 473/342
5,720,673 A * 2/1998 Anderson ..... A63B 53/04 473/324
5,807,189 A * 9/1998 Martin ..... A63B 53/04 473/331

(Continued)

FOREIGN PATENT DOCUMENTS

JP 08066498 A * 3/1996
JP 09135934 A * 5/1997

(Continued)

*Primary Examiner* — Alvin Hunter
(74) *Attorney, Agent, or Firm* — Birch, Stewart, Kolasch & Birch, LLP

(57) ABSTRACT

A head 2 includes a head body h1 and a face plate p1. The face plate p1 includes a plate front surface f1 having a hitting face 4, and a plate back surface b1. The plate front surface f1 has, on a peripheral edge part thereof, a step surface t1 positioned at a rear with respect to the hitting face 4. The head body h1 has a receipt surface u1 positioned at a rear of the plate back surface b1, a front disposition part z1 positioned at a front of the step surface t1, and a hosel 6. The front disposition part z1 includes a plastically deformed part d1 and a non-plastically deformed part n1. A clearance between the non-plastically deformed part n1 and the receipt surface u1 forms an engaging part E1 engaging a peripheral edge part of the face plate p1.

12 Claims, 19 Drawing Sheets

(56) References Cited

U.S. PATENT DOCUMENTS 5,899,820 A * 5/1999 Minematsu ..... A63B 53/04 473/329
5,993,331 A * 11/1999 Shieh ..... A63B 53/04 473/342
6,001,032 A * 12/1999 Onuki ..... A63B 53/04 473/342
6,050,904 A * 4/2000 Kuo ..... A63B 53/04 473/342
6,183,377 B1 * 2/2001 Liang ..... A63B 53/04 164/112
6,224,496 B1 * 5/2001 Rowland ..... A63B 53/04 473/288
6,491,593 B2 * 12/2002 Takeda ..... A63B 53/04 473/342
6,780,124 B2 * 8/2004 Lu ..... A63B 53/0466 473/342
6,852,041 B1 * 2/2005 Huang ..... A63B 53/047 29/458
6,971,961 B2 * 12/2005 Chen ..... A63B 53/04 473/342
6,991,559 B2 * 1/2006 Yabu ..... A63B 53/04 473/332
7,025,693 B2 * 4/2006 Sugimoto ..... A63B 53/04 473/342
7,258,628 B2 * 8/2007 Huang ..... A63B 53/0466 473/342
7,431,665 B2 * 10/2008 Sugimoto ..... A63B 53/047 473/342
7,597,633 B2 * 10/2009 Shimazaki ..... A63B 53/047 473/329
7,651,413 B1 * 1/2010 Chen ..... A63B 53/0475 473/342
8,012,040 B2 * 9/2011 Takechi ..... A63B 53/047 473/329
8,210,965 B2 * 7/2012 Roach ..... A63B 53/04 473/329
8,342,985 B2 * 1/2013 Hirano ..... A63B 53/047 473/331

FOREIGN PATENT DOCUMENTS

JP 2691496 B2 12/1997
JP 10108926 A * 4/1998
JP 10155949 A * 6/1998
JP 10155950 A * 6/1998
JP 10192455 A * 7/1998
JP 10192456 A * 7/1998
JP 10192457 A * 7/1998
JP 10192458 A * 7/1998
JP 11319165 A * 11/1999
JP 11333033 A * 12/1999
JP 2000342724 A * 12/2000
JP 2001046561 A * 2/2001
JP 2001170222 A * 6/2001
JP 2003245385 A * 9/2003
JP 2006081860 A * 3/2006
JP 2007021171 A * 2/2007
JP 2008183362 A * 8/2008

* cited by examiner

GOLF CLUB HEAD

The present application claims priority on Patent Application No. 2015-248137 filed in JAPAN on Dec. 21, 2015, the entire contents of which are hereby incorporated by reference.

BACKGROUND OF THE INVENTION

Field of the Invention

The present invention relates to a golf club head.

Description of the Related Art

There has been known an iron type golf club head including a head body and a face plate attached to the head body. Japanese Patent No. 2691496 discloses a head in which a projection engaged with a recess of a face body to fix the face body to a head body is formed by the plastic deformation of a part of the head body.

SUMMARY OF THE INVENTION

The present inventors have found that a non-conventional new structure is allowed in a head to which a face plate is attached. This new structure can exhibit an effect heterogeneous from the effect of the conventional technique.

The present embodiments provide a golf club head having a structure where a face plate is attached to a head body, and having a new effect.

In one aspect, a golf club head includes a head body, and a face plate fixed to the head body. The face plate includes a plate front surface having a hitting face, and a plate back surface which is a surface opposite to the plate front surface. The plate front surface has, on a peripheral edge part thereof, a step surface positioned at a rear with respect to the hitting face. The head body has a receipt surface positioned at a rear of the plate back surface, a front disposition part positioned at a front of the step surface, and a hosel. The front disposition part has a plastically deformed part and a non-plastically deformed part. A clearance between the non-plastically deformed part and the receipt surface forms an engaging part engaging the peripheral edge part of the face plate.

In another aspect, the front disposition part is provided in each of a toe side region, a heel side region, a top side region, and a sole side region. Preferably, the non-plastically deformed part is provided in only the heel side region.

In another aspect, the head body includes a plane part constituting a part of the hitting face, a curved surface part connecting the plane part and the hosel, and a boundary between the plane part and the curved surface part. Preferably, a toe-heel direction distance D1 between a toe side end of the non-plastically deformed part and the boundary is equal to or less than 5 mm.

In another aspect, the front disposition part is provided in each of a toe side region, a heel side region, a top side region, and a sole side region. The non-plastically deformed part may be provided in only the toe side region.

A peripheral length of the front disposition part is defined as L1 and a peripheral length of the non-plastically deformed part is defined as L2. At this time, in another aspect, L2/L1 is 0.06 or greater but 0.30 or less.

In another aspect, A method for manufacturing a head, includes a step of preparing a head body having a face opening, and a face plate, and a plate attaching step of attaching the face plate to the face opening. The face plate includes a plate front surface having a hitting face, and a plate back surface which is a surface opposite to the plate front surface. The plate front surface has, on a peripheral edge part thereof, a step surface positioned at a rear with respect to the hitting face. The head body includes a receipt surface positioned at a rear of the face opening, an undeformed projection provided along an outer edge of the face opening, a non-plastically deformed part disposed to be opposed to the receipt surface, and an engaging part formed by a clearance between the non-plastically deformed part and the receipt surface. Preferably, the plate attaching step includes the following steps:

(1) a first step of disposing the face plate at a final position in the face opening while inserting a portion in which the step surface is formed in the face plate into the engaging part of the head body; and (2) a second step of plastically deforming the undeformed projection to form a plastically deformed part positioned at a front of the step surface.

A new effect can be added to a head having a structure where a face plate is attached to a head body.

DESCRIPTION OF THE PREFERRED EMBODIMENTS

Hereinafter, some aspects will be described in detail according to the embodiments with appropriate references to the accompanying drawings.

In the present application, the following terms are defined.

[Base State]

The base state is in a state where a head is placed at a specified lie angle and real loft angle on a level surface h. In the base state, a center axis line (shaft axis line) of a shaft hole of the head is provided in a perpendicular plane VP1. The perpendicular plane VP1 is a plane perpendicular to the level surface h. In the base state, a face surface (hitting face) is inclined at a real loft angle with respect to the perpendicular plane VP1. The specified lie angle and real loft angle are described in, for example, a product catalog or the like.

[Toe-Heel Direction]

In the head of the base state, a direction of an intersection line between the perpendicular plane VP1 and the level surface h is the toe-heel direction. A toe side and a heel side used in the present application should be based on the toe-heel direction.

[Face-Back Direction]

A direction perpendicular to the toe-heel direction and parallel to the level surface h is the face-back direction. A face side and a back side used in the present application should be based on the face-back direction.

[Front-Rear Direction]

A direction perpendicular to the hitting face is defined as the front-rear direction. In other words, a normal direction of the hitting face is defined as the front-rear direction. Front and rear used in the present application should be based on the front-rear direction.

[Up-Down Direction]

A direction perpendicular to the toe-heel direction and parallel to the hitting face is the up-down direction. Above and below used in the present application should be based on the up-down direction.

Figure 1:
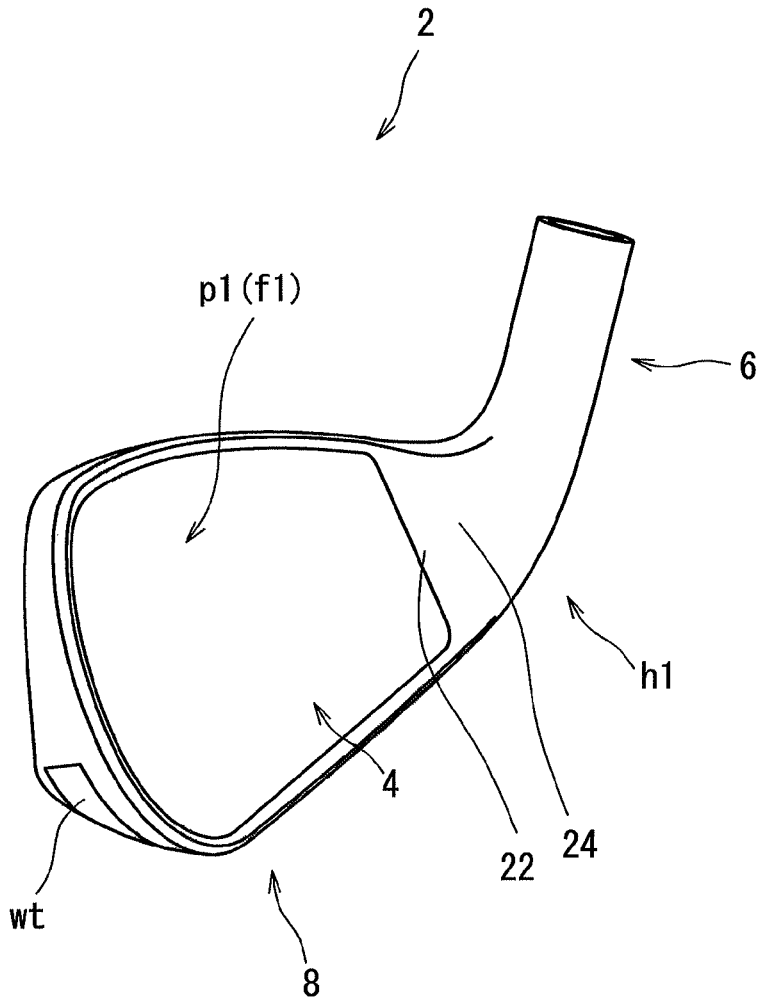
FIG. 1 is a perspective view of a golf club head of a first embodiment.
Figure 2:
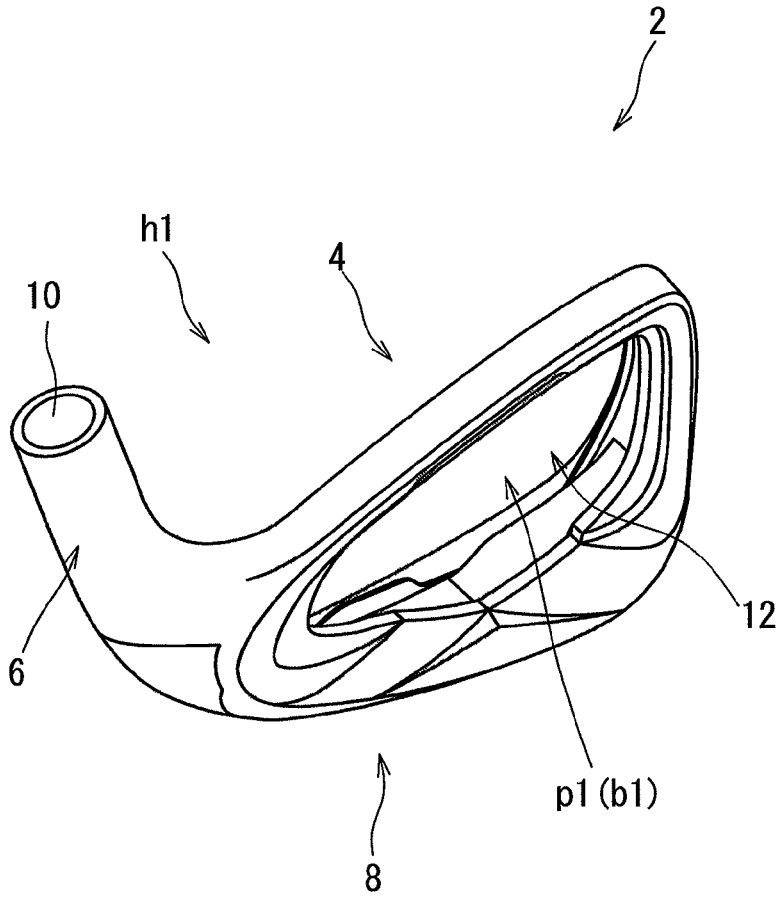
FIG. 2 is a perspective view showing the back surface of the head of FIG. 1.
Figure 3:
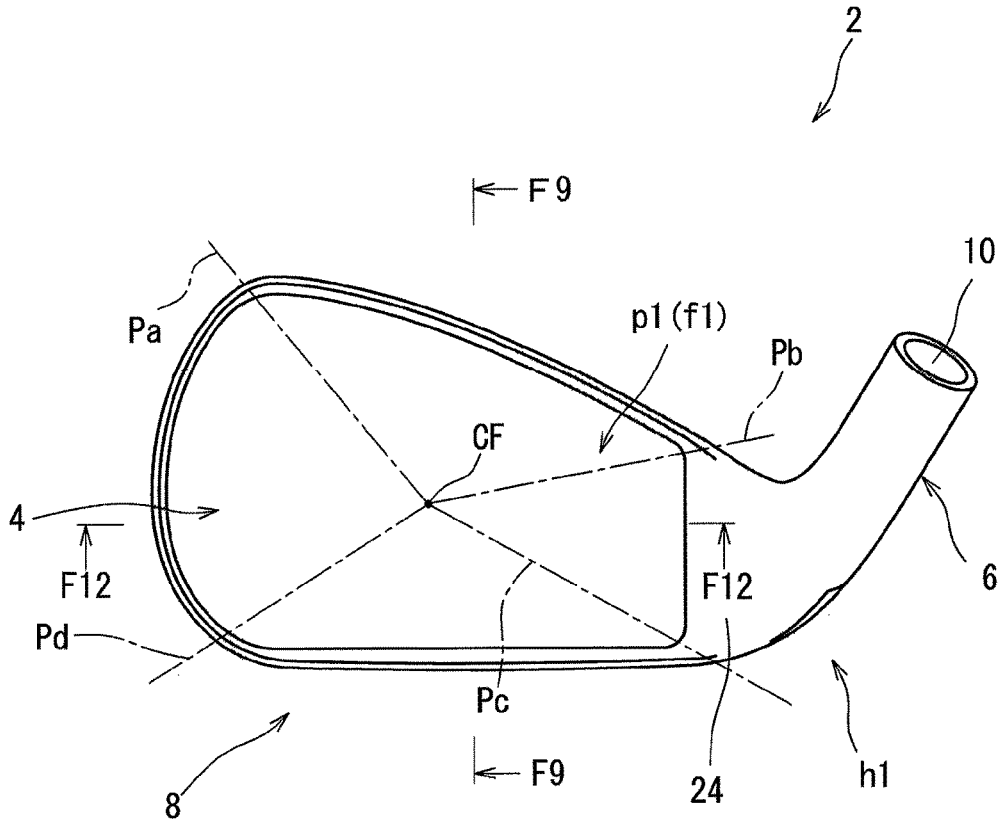
FIG. 3 is a front view of the head of FIG. 1.
Figure 4:
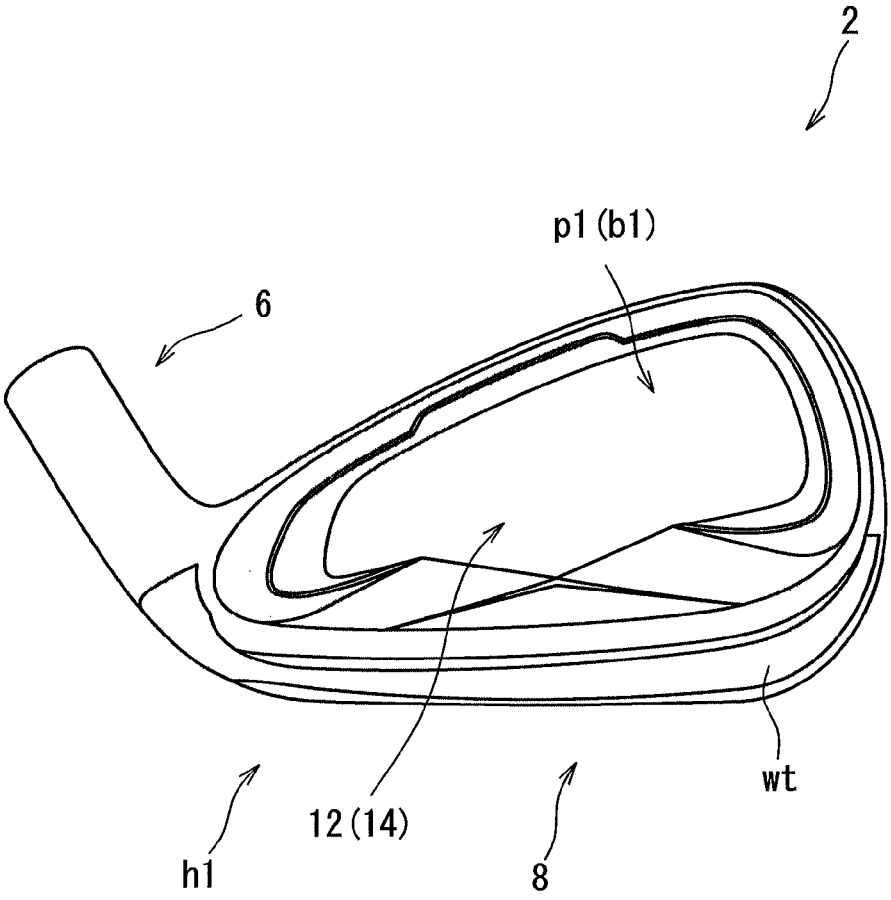
FIG. 4 is a back view of the head of FIG. 1.

FIG. 1 is a perspective view of a golf club head 2 according to a first embodiment when the golf club head 2 is seen from an obliquely front side. FIG. 2 is a perspective view of the head 2 when the head 2 is seen from an obliquely rear side. FIG. 3 is a front view of the head 2. FIG. 3 is a front view of the hitting face. FIG. 4 is a back view of the head 2.

The head 2 includes a face 4, a hosel 6, and a sole 8. The hosel 6 has a hosel hole 10. The face 4 is a hitting face. A plurality of score lines are formed in the surface of the hitting face 4. However, the description of the score line is omitted except for FIG. 14 to be described later. Except for the score lines, the hitting face 4 is a plane. A weight member wt is disposed in the sole 8. The head 2 is an iron type golf club head.

A back cavity 12 is provided on a side opposite to the hitting face 4. The head 2 is a cavity back iron.

The head 2 includes a head body h1 and a face plate p1 fixed to head body h1. The head body h1 is made of a metal. In the present embodiment, the head body h1 is made of stainless steel. The face plate p1 is made of a metal. In the present embodiment, the face plate p1 is made of a titanium-based metal. The titanium-based metal means pure titanium or a titanium alloy. The materials of the head body h1 and face plate p1 are not limited.

The titanium alloy is an alloy containing 50% by weight or greater of titanium. Examples of the titanium alloy include α titanium, αβ titanium, and β titanium. Examples of the α titanium include Ti-5Al-2.5Sn and Ti-8Al-1V-1Mo. Examples of the αβ titanium include Ti-6Al-4V, Ti-6Al-2Sn-4Zr-6Mo, Ti-6Al-6V-2Sn, and Ti-4.5Al-3V-2Fe-2Mo. Examples of the β titanium include Ti-15V-3Cr-3Sn-3Al, Ti-20V-4Al-1Sn, Ti-22V-4Al, Ti-15Mo-2.7Nb-3Al-0.2Si, and Ti-16V-4Sn-3Al-3Nb. Examples of the pure titanium include industry pure titanium. Examples of the industry pure titanium include pure titanium of type 1, pure titanium of type 2, pure titanium of type 3, and pure titanium of type 4 which are prescribed by Japanese Industrial Standard.

Preferably, the specific gravity of the face plate p1 is smaller than the specific gravity of the head body h1. The face plate p1 having a smaller specific gravity contributes to the distribution of the weight of the head 2 to the circumference.

Figure 5:
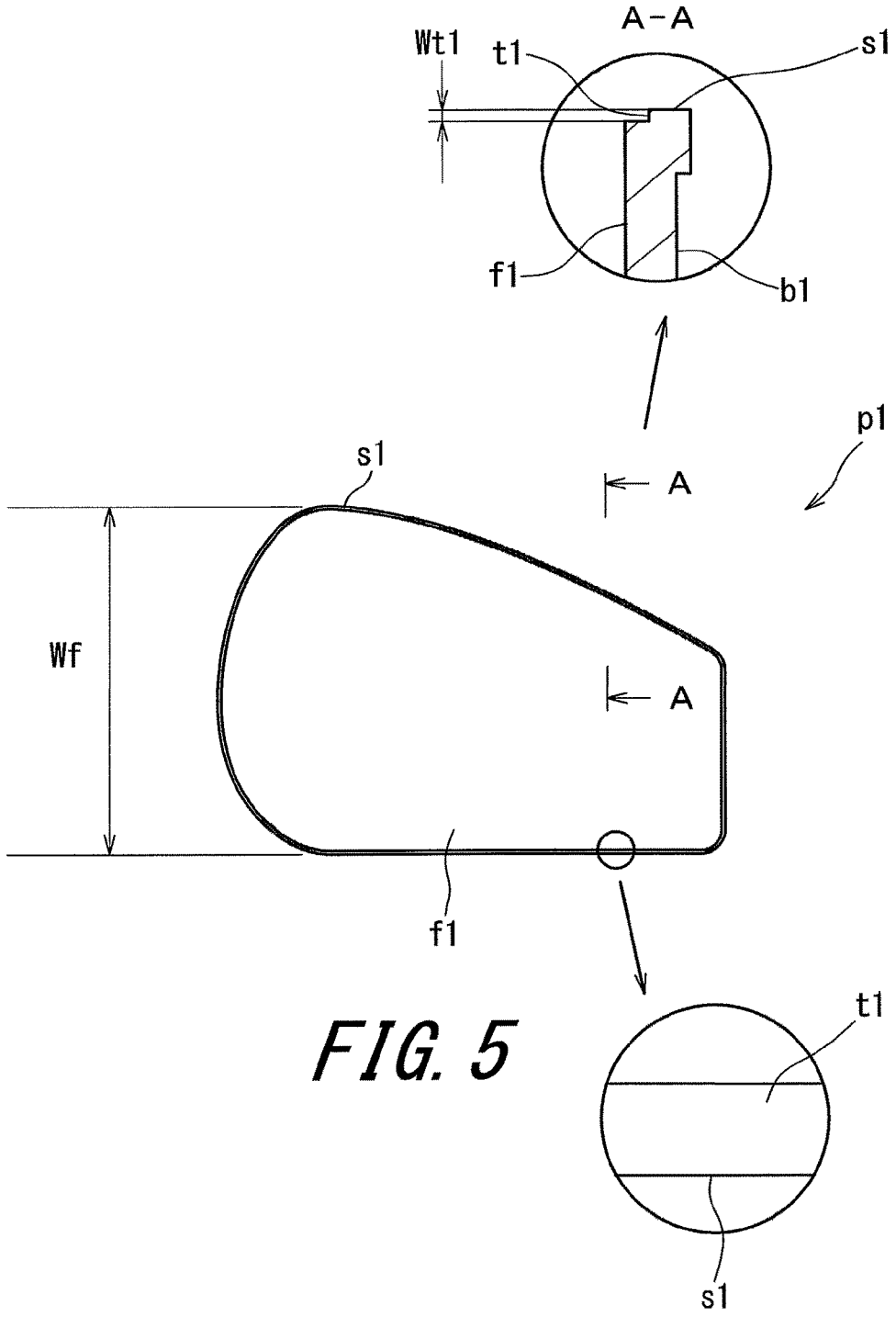
FIG. 5 is a plan view of a face plate according to the head of FIG. 1.
Figure 6:
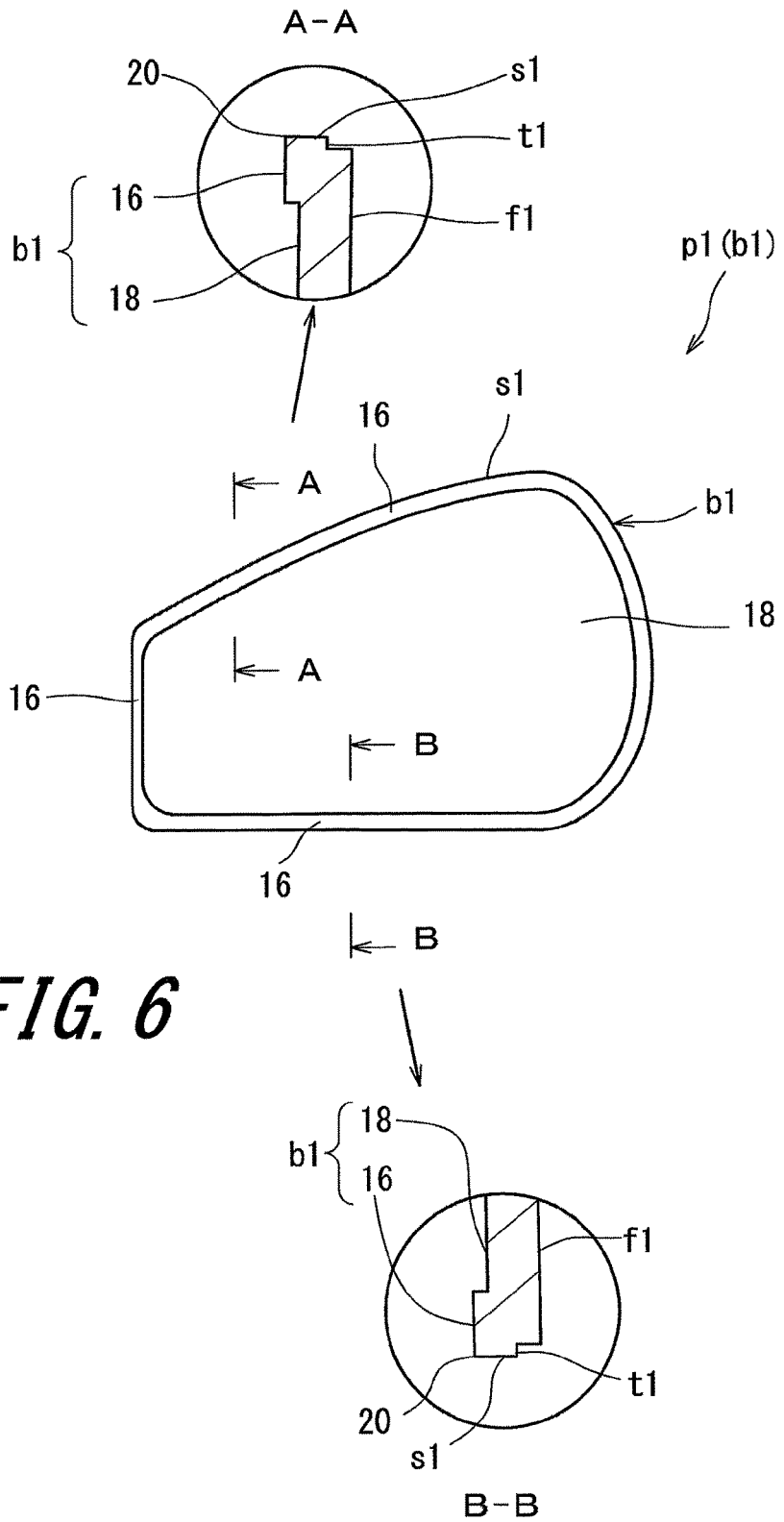
FIG. 6 is a back view of the face plate of FIG. 5.

FIG. 5 is a plan view of the face plate p1. FIG. 6 is a back view of the face plate p1. The face plate p1 includes a plate front surface f1, a plate back surface b1, and a plate side surface s1. The plate front surface f1 includes a hitting face. The hitting face is a plane except for the score line. The plate back surface b1 is a surface opposite to the plate front surface f1. The plate side surface s1 extends between the plate front surface f1 and the plate back surface b1. The face plate p1 has a step surface t1. In more detail, the plate front surface f1 has, on a peripheral edge part thereof, a step surface t1. The step surface t1 is provided over the whole peripheral edge part of the plate front surface f1. The step surface t1 may be provided in a part of the peripheral edge part of the plate front surface f1.

Figure 11A:
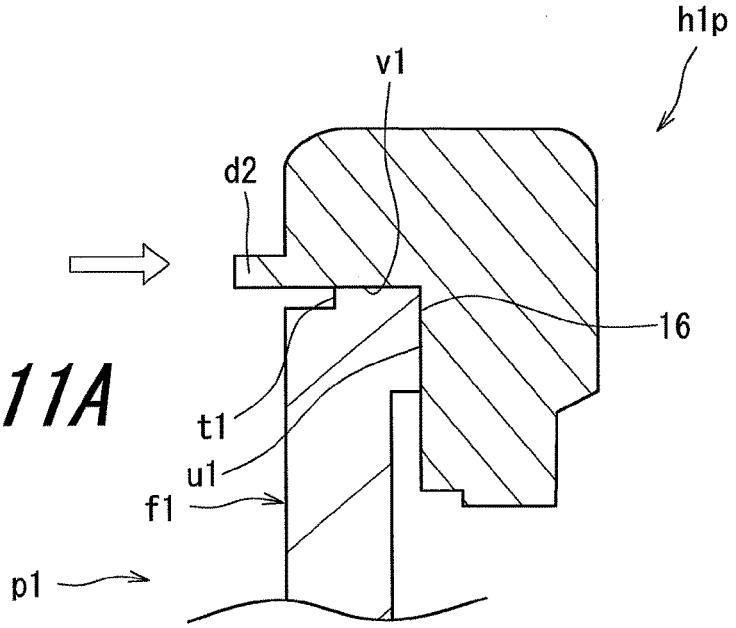
FIGS. 11A and 11B illustrate a step (caulking step) in which the plastically deformed part is formed.

As shown in FIG. 5, and FIG. 11A to be described later, a peripheral edge part of the plate front surface f1 includes a step surface t1 positioned at a rear with respect to the hitting face 4. As shown in FIG. 5, the step surface t1 is provided over the whole circumference of the face plate p1.

From the viewpoint of fixing the face plate p1, a width Wt1 (see FIG. 5) of the step surface t1 is preferably equal to or greater than 0.2 mm, and more preferably equal to or greater than 0.3 mm. In light of the formation of the plastically deformed part d1, the width Wt1 is preferably equal to or less than 2 mm, and more preferably equal to or less than 1 mm.

The width Wt1 may change or be constant. In the present embodiment, the width Wt1 is constant. The width Wt1 is preferably constant from the viewpoint of productivity.

Figure 7:
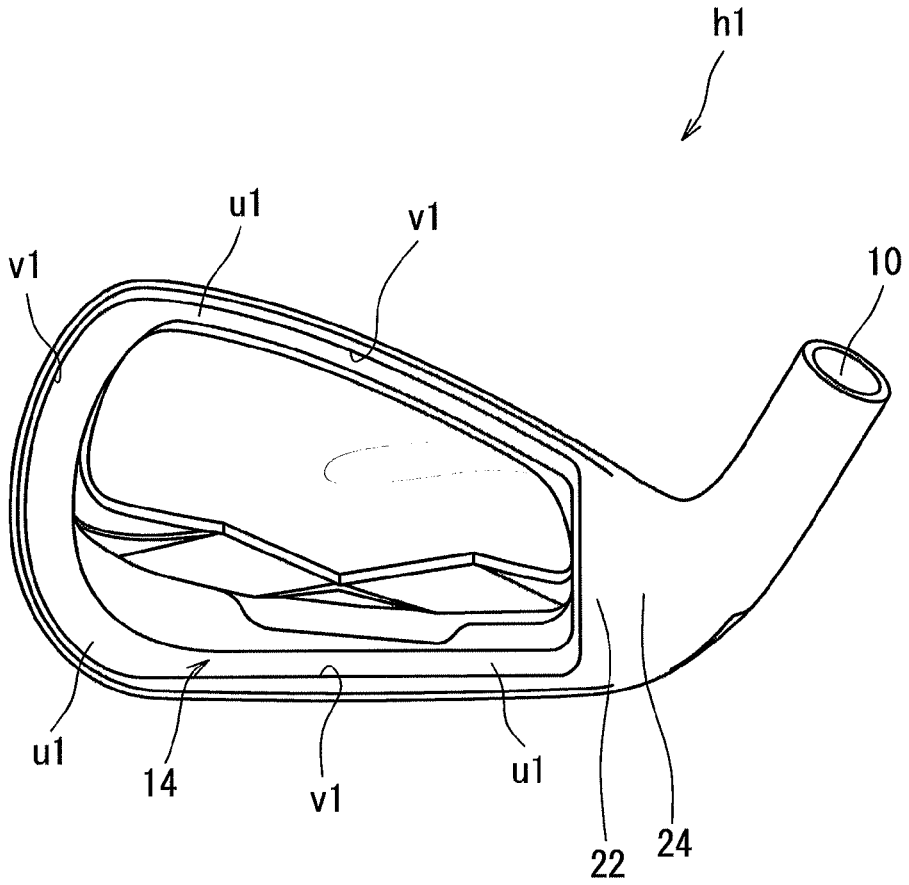
FIG. 7 is a front view of a head body according to the head of FIG. 1.

FIG. 7 is a front view of the head body h1. The head body h1 has a face opening 14. The contour of the face opening 14 is substantially equal to the contour of the face plate p1.

The head body h1 includes a receipt surface u1 which supports the plate back surface b1 of the face plate p1, and a body side surface v1 which is opposed to the plate side surface s1. The receipt surface u1 is positioned at a rear of the plate back surface b1. The whole receipt surface u1 is constituted by a single plane. The receipt surface u1 is provided over the whole circumference of the face opening 14. The body side surface v1 is provided over the whole circumference of the face plate p1. A part of the plate back surface b1 is brought into contact with the receipt surface u1. In FIG. 7, the description of a front disposition part z1 (to be described later) is omitted.

Figure 8:
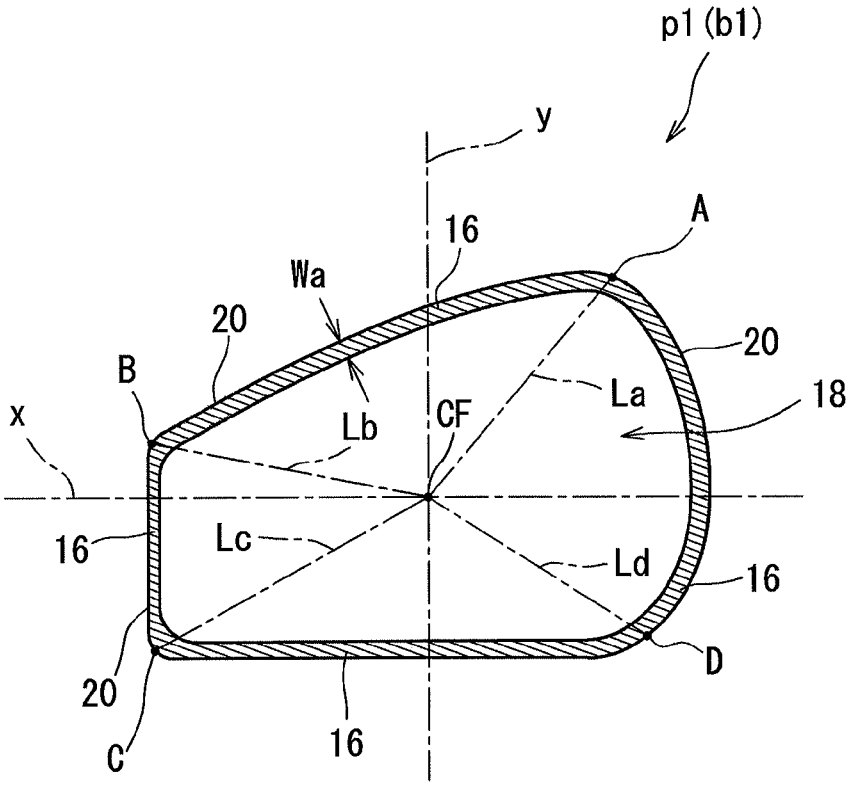
FIG. 8 is the same back view as FIG. 6.

FIG. 8 shows the plate back surface b1 as in FIG. 6. An outer peripheral edge part 16 is shown by hatching in FIG. 8. As shown in FIG. 8, the plate back surface b1 includes an outer peripheral edge part 16 having a circular shape, and an inner side part 18 located on the inner side of the outer peripheral edge part 16. The inner side part 18 is surrounded by the outer peripheral edge part 16.

The outer peripheral edge part 16 includes a contour line 20 of the plate back surface b1. That is, the outer contour line of the outer peripheral edge part 16 is the contour line 20. The outer peripheral edge part 16 has a width Wa. The width Wa is preferably equal to or greater than 1 mm, and more preferably equal to or greater than 1.3 mm. The width Wa is preferably equal to or less than 6 mm, and more preferably equal to or less than 5 mm.

A centroid of the plate back surface b1 is shown by reference character CF in FIG. 8. The centroid CF is determined based on the contour line 20 of the plate back surface b1.

In the plan view in FIG. 8, a straight line x and a straight line y are defined. The straight line x is a straight line passing through the centroid CF and being parallel to the toe-heel direction. The straight line y is a straight line passing through the centroid CF and being parallel to the up-down direction.

As shown in FIG. 8, the contour line 20 is sectioned into four by the straight line x and the straight line y. A point having the minimum curvature radius is determined in each of these four sections. A point having the smallest curvature radius in a toe upper side section is shown by reference character A. A point having the smallest curvature radius in a heel upper side section is shown by reference character B. A point having the smallest curvature radius in a heel lower side section is shown by reference character C. A point having the smallest curvature radius in a toe lower side section is shown by reference character D. A straight line which connects the point A and the centroid CF is a straight line La. A straight line which connects the point B and the centroid CF is a straight line Lb. A straight line which connects the point C and the centroid CF is a straight line Lc. A straight line which connects the point D and the centroid CF is a straight line Ld.

The head 2 may be comparted into four by three-dimensionally enlarging these straight lines. A plane Pa including the straight line La and being perpendicular to the hitting face, a plane Pb including the straight line Lb and being perpendicular to the hitting face, a plane Pc including the straight line Lc and being perpendicular to the hitting face, and a plane Pd including the straight line Ld and being perpendicular to the hitting face are defined (see FIG. 3). The head 2 is comparted into a toe side region, a heel side region, a top side region, and a sole side region by these four planes Pa, Pb, Pc, and Pd. Therefore, for example, each of the head body h1 and the face plate p1 is also comparted into the toe side region, the heel side region, the top side region, and the sole side region. Thus, the four regions (toe side region, heel side region, top side region, and sole side region) in the present application are defined. The toe side region, the heel side region, the top side region, and the sole side region are generically referred to as a four-section region.

The four-section region is applied to all the portions of the head 2. For example, the front disposition part z1 (to be described later) is comparted into the toe side region, the heel side region, the top side region, and the sole side region.

The outer peripheral edge part 16 forms a protruded part protruded to a rear of the inner side part 18. The thickness of the outer peripheral edge part 16 is greater than the thickness of the inner side part 18. As shown in FIG. 6, the outer peripheral edge part 16 is provided over the whole circumference of the face plate p1. The outer peripheral edge part 16 abuts on the head body h1. The inner side part 18 does not abut on the head body h1.

A protruded part corresponding to the outer peripheral edge part 16 can also be provided on the head body h1. However, when the specific gravity of the head body h1 is greater than the specific gravity of the face plate p1, the setting of the protruded part leads to an increase in a head weight. In addition, the shape of the head body h1 is more complicated than the shape of the face plate p1, which is less likely to subject the head body h1 to a process (for example, NC process). The face plate p1 has a plate shape, which is easily processed.

Figure 9:
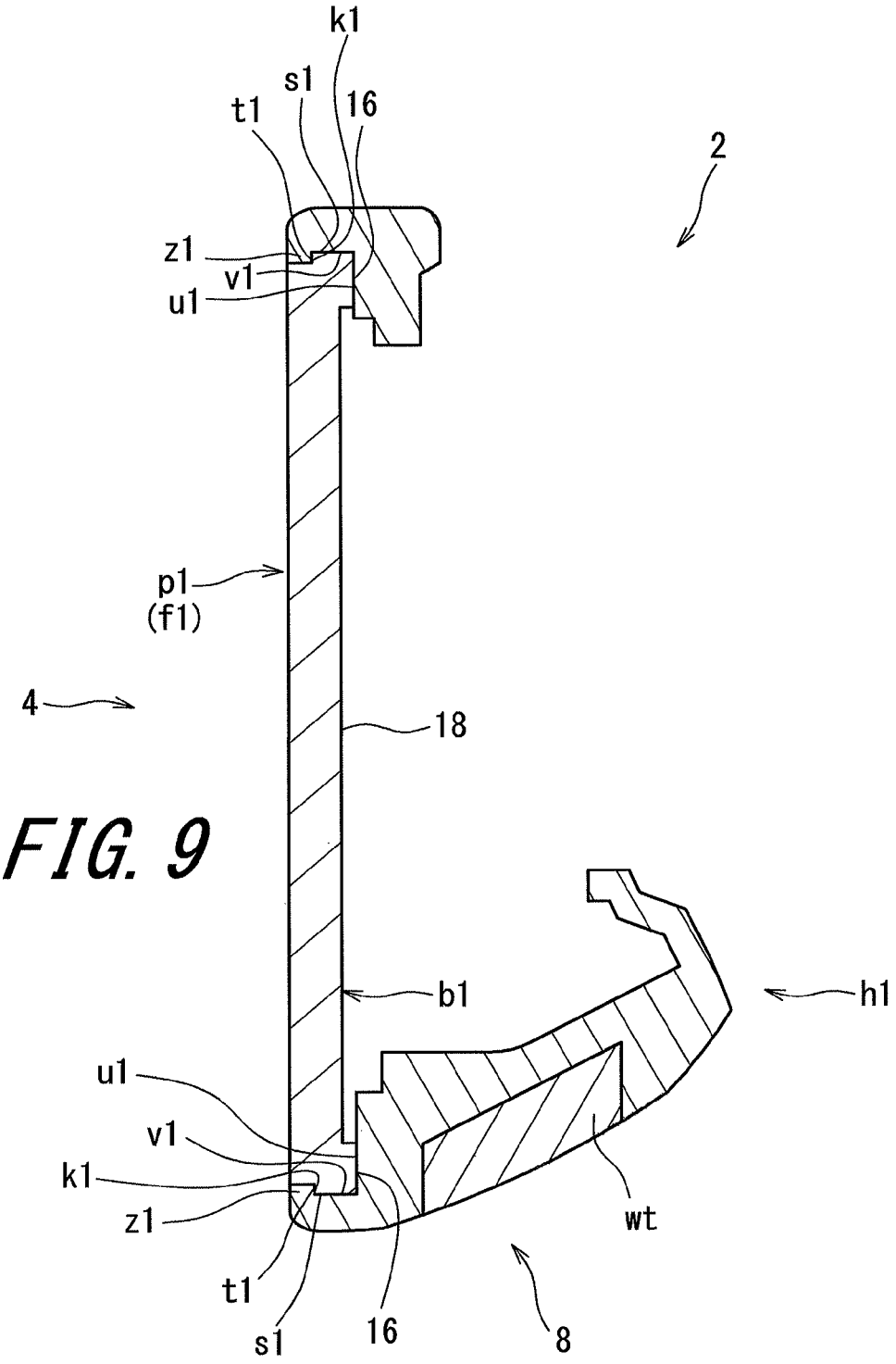
FIG. 9 is a sectional view taken along line F9-F9 of FIG. 3.

FIG. 9 is a sectional view taken along line F9-F9 of FIG. 3. As shown in FIG. 9, the outer peripheral edge part 16 (protruded part) abuts on the receipt surface u1. The outer peripheral edge part 16 forms the protruded part protruded so that the outer peripheral edge part 16 abuts on the receipt surface u1. Meanwhile, the inner side part 18 does not abut on the receipt surface u1.

As shown in FIG. 9, the head body h1 has a front disposition part z1. The front disposition part z1 is positioned at a front of the face plate p1. In more detail, the front disposition part z1 is positioned at a front of the step surface t1. The front disposition part z1 prevents the face plate p1 from coming off to the front.

The front disposition part z1 has an opposed surface k1 which is opposed to the receipt surface u1. The opposed surface k1 is brought into contact with the step surface t1. The front disposition part z1 covers the front of the step surface t1.

The front disposition part z1 is classified into two kinds. The two kinds are a plastically deformed part d1 and a non-plastically deformed part n1. The front disposition part z1 has the plastically deformed part d1 and the non-plastically deformed part n1. The plastically deformed part d1 is formed by plastic deformation. The plastically deformed part d1 has a metal structure formed by the plastic deformation. The non-plastically deformed part n1 is formed by methods excluding the plastic deformation. The non-plastically deformed part n1 has a metal structure formed by methods other than the plastic deformation. The non-plastically deformed part n1 does not have a metal structure formed by the plastic deformation.

It is generally known that the plastic deformation of a metal is provided by atom slip with a specific crystal plane as a boundary. When a linear lattice defect moves, the slip is generated. The linear lattice defect is referred to as dislocation. It is also known that the rotation of a crystal is caused in the plastic deformation. Furthermore, it is known that a crystal grain is stretched in cold rolling which causes a large deformation amount. By observing the metal structure, the presence or absence of the plastic deformation can be distinguished. The plastically deformed part d1 and the non-plastically deformed part n1 can be distinguished from each other based on known knowledges.

Thus, the plastically deformed part d1 is a portion formed by the plastic deformation. Preferably, an undeformed portion is formed as with the non-plastically deformed part n1. Preferably, the undeformed portion is formed when the head body h1 is formed. The undeformed portion means a state before the plastically deformed part d1 is plastically deformed. An undeformed projection d2 to be described later is an example of the undeformed portion.

The non-plastically deformed part n1 is a portion formed by methods other than the plastic deformation. For example, the non-plastically deformed part n1 is a portion formed by the formation of the head body h1. A method for forming the non-plastically deformed part n1 is the same as the method for forming the head body h1. Examples of the method for forming the non-plastically deformed part n1 include casting, forging, press process, cutting process (NC process or the like), and a combination thereof. The non-plastically deformed part n1 may be formed by subjecting the head body h1 obtained by one or more processes selected from casting, forging, and press process to NC process.

Figure 10:
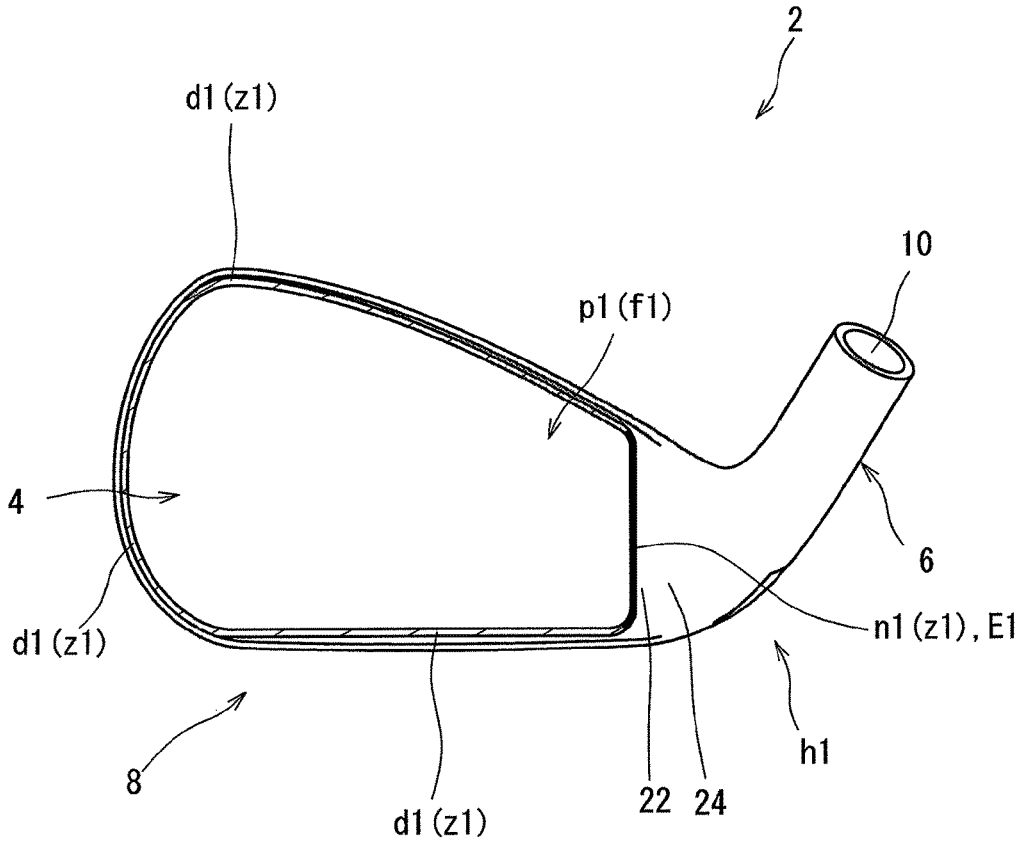
FIG. 10 is the same front view as FIG. 3, and in FIG. 10, a non-plastically deformed part is shown by a thick line (solid black), and a plastically deformed part is shown by hatching.

FIG. 10 is a front view showing the positions of the non-plastically deformed part n1 and the plastically deformed part d1. Usually, with the naked eye, the non-plastically deformed part n1 and the plastically deformed part d1 cannot be distinguished from each other. A portion shown by a thick line in FIG. 10 is the non-plastically deformed part n1. A portion shown by hatching in FIG. 10 is the plastically deformed part d1.

The front disposition part z1 is provided in each of the toe side region, the heel side region, the top side region, and the sole side region. The front disposition part z1 is provided over the whole circumference of the face plate p1.

The non-plastically deformed part n1 is provided in the heel side region. The non-plastically deformed part n1 is provided in only the heel side region. The non-plastically deformed part n1 has a straight part extending along a straight line. The non-plastically deformed part n1 is provided in the heel side region, and the plastically deformed part d1 is not provided in the heel side region. The non-plastically deformed part n1 is not provided in the top side region. The plastically deformed part d1 is provided in the top side region, and the non-plastically deformed part n1 is not provided in the top side region. The non-plastically deformed part n1 is not provided in the toe side region. The plastically deformed part d1 is provided in the toe side region, and the non-plastically deformed part n1 is not provided in the toe side region. The non-plastically deformed part n1 is not provided in the sole side region. The plastically deformed part d1 is provided in the sole side region, and the non-plastically deformed part n1 is not provided in the sole side region.

The whole front disposition part z1 in the toe side region is the plastically deformed part d1. The whole front disposition part z1 in the top side region is the plastically deformed part d1. The whole front disposition part z1 in the sole side region is the plastically deformed part d1.

The whole front disposition part z1 in the heel side region is the non-plastically deformed part n1. The front disposition part z1 in the heel side region may have the non-plastically deformed part n1 and the plastically deformed part d1.

Figure 11B:
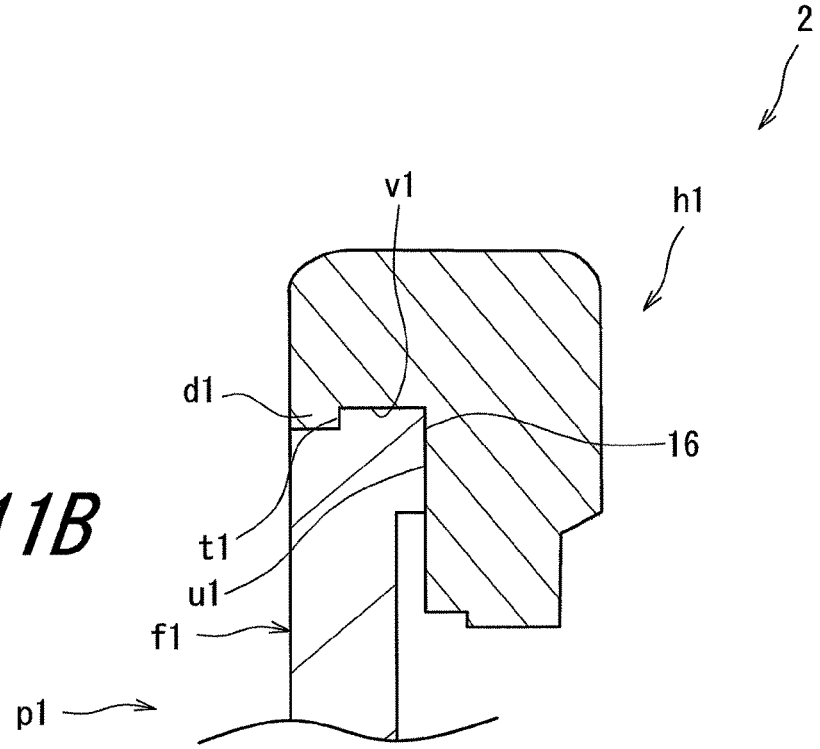

FIGS. 11A and 11B show a procedure of the formation of the plastically deformed part d1.

In a method for forming the plastically deformed part d1, first, a head body hip including an undeformed projection d2 (see FIG. 11A) is prepared. The head body hip is also referred to as an undeformed body. Although not shown, a non-plastically deformed part n1 is already formed in the head body hip. The head body hip includes the non-plastically deformed part n1 and the undeformed projection d2.

As shown in FIG. 11A, the face plate p1 is set in the undeformed body hip. Next, process is conducted, in which the undeformed projection d2 is crushed by a pressing body having a plane parallel to the hitting face. The process is also referred to as plane process. The undeformed projection d2 is plastically deformed to move to a space positioned at a front of the step surface t1. As a result, at least a part of the space positioned at a front of the step surface t1 is filled, which provides the formation of the plastically deformed part d1. The step is also referred to as a caulking step. The plastically deformed part d1 is also referred to as a caulking part.

Such a process method may cause a stress to remain in the plastically deformed part d1. The plastically deformed part d1 may press the face plate p1. The plastically deformed part d1 may press the step surface t1.

The plastically deformed part d1 is positioned at a front of the face plate p1. Therefore, the plastically deformed part d1 physically prevents the face plate p1 from coming off to the front. Furthermore, the non-plastically deformed part n1 is also positioned at a front of the face plate p1. The non-plastically deformed part n1 also physically prevents the face plate p1 from coming off to the front.

In the head body h1*p* of the present embodiment, the undeformed projection d2 is provided in a part of the circumference of the face opening 14. The position in which the undeformed projection d2 is provided corresponds to the position of the plastically deformed part d1 shown in FIG. 10. The undeformed projection d2 is subjected to the process. As a result, the plastically deformed part d1 is provided in a part of the peripheral edge of the face plate p1.

Figure 12:
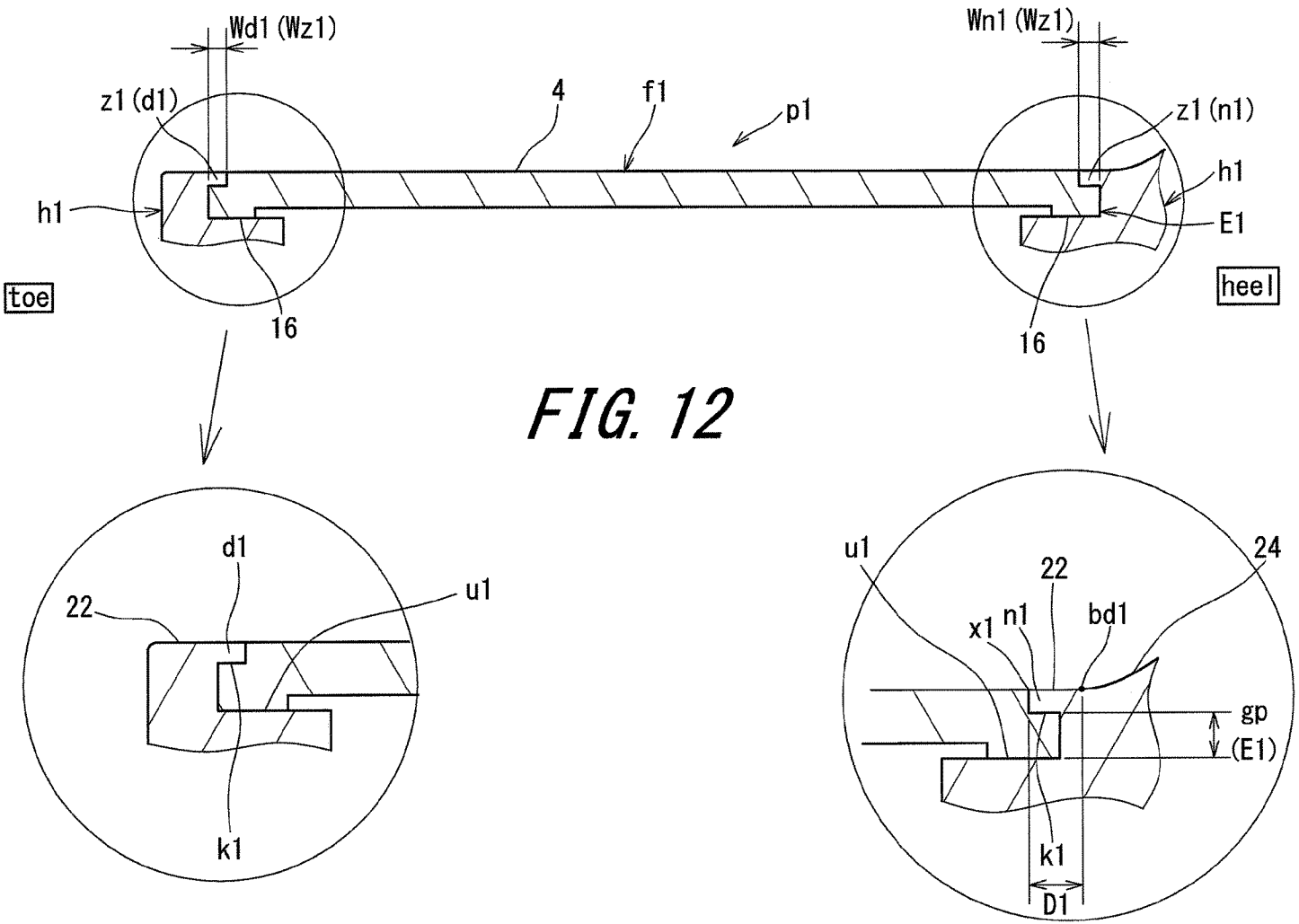
FIG. 12 is a sectional view taken along line F12-F12 of FIG. 3.

FIG. 12 is a sectional view of the head 2 taken along line F12-F12 of FIG. 3. At the sectional position of FIG. 12, the front disposition part z1 positioned on a heel side is the non-plastically deformed part n1, and the front disposition part z1 positioned on a toe side is the plastically deformed part d1.

The opposed surface k1 of the non-plastically deformed part n1 and the receipt surface u1 are separated from each other. In other words, a clearance gp is present between the non-plastically deformed part n1 and the receipt surface u1. An engaging part E1 engaging the peripheral edge part of the face plate p1 is formed by the clearance gp. The peripheral edge part of the face plate p1 is inserted into the engaging part E1.

As shown in FIG. 12, a part of the hitting face 4 is constituted by the face plate p1. A part of the hitting face 4 is constituted by the head body h1. The head body h1 includes a plane part 22 constituting the hitting face 4, and a curved surface part 24 connecting the plane part 22 and the hosel 6. The curved surface part 24 is a concave curved surface. A boundary bd1 between the plane part 22 and the curved surface part 24 is positioned on a heel side with respect to the face plate p1. In the sectional view, the boundary bd1 is a starting point of the curved surface part 24. In the present embodiment, the boundary bd1 is a straight line extending along the up-down direction. The boundary bd1 may extend in the up-down direction in a state where it is measurably curved.

Figures 13A, 13B, 13C:
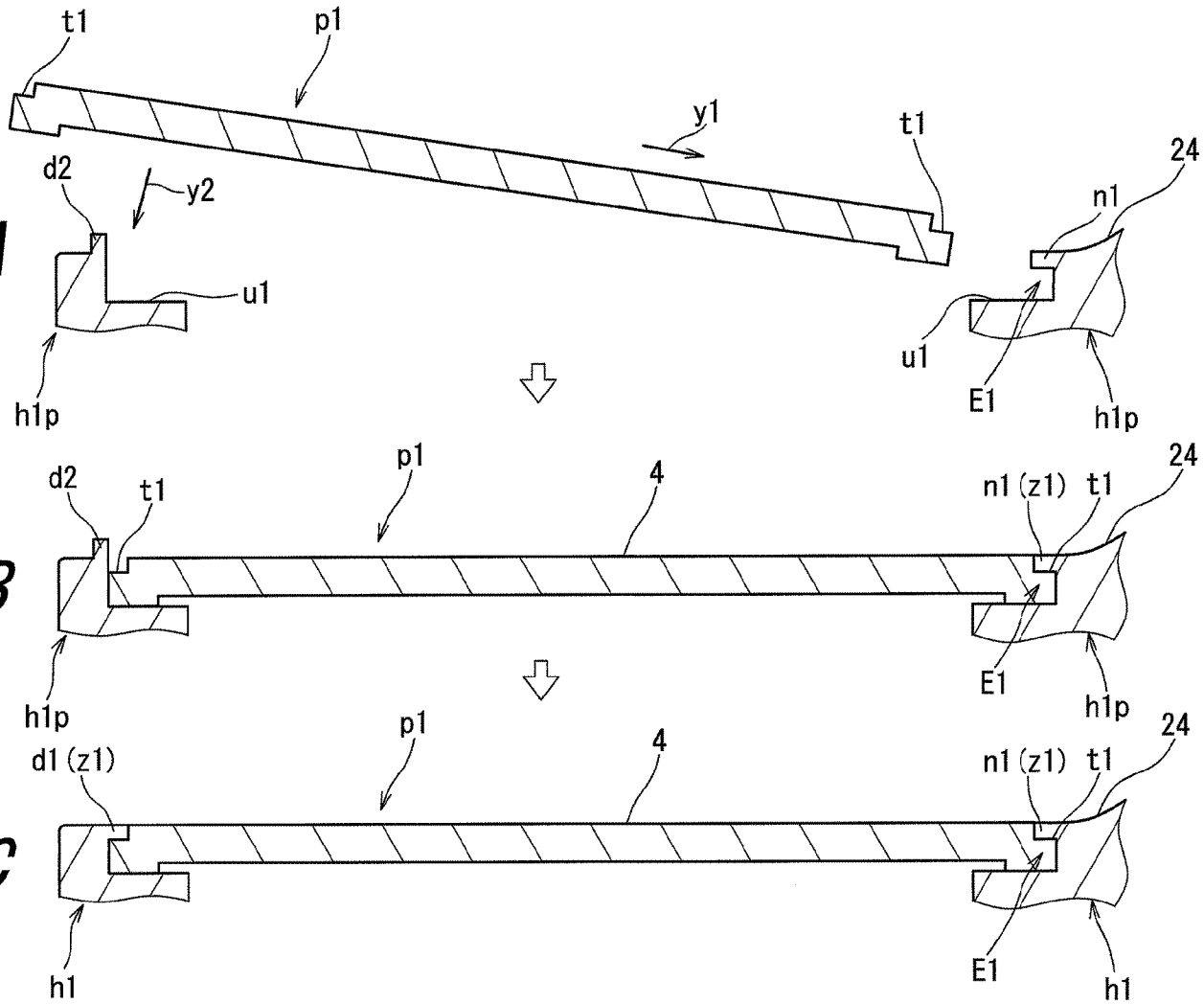
FIGS. 13A to 13C illustrate a plate attaching step.

FIGS. 13A to 13C are sectional views for describing an attaching step (plate attaching step) of the face plate p1.

The plate attaching step includes the following steps:

(1) a first step of disposing the face plate p1 at a final position in the face opening 14 while inserting a portion in which the step surface t1 is formed in the face plate p1 into the engaging part E1 of the head body h1 (see FIGS. 13A and 13B); and (2) a second step of plastically deforming the undeformed projection d2 to form a plastically deformed part d1 positioned at a front of the step surface t1 (see FIGS. 13B and 13C).

The final position in the first step is the position of the face plate p1 in the completed head 2. The second step is the above-mentioned caulking step.

In the first step, a first peripheral edge part of the face plate p1 is inserted into the engaging part E1 (see an arrow y1 of FIG. 13A). With the insertion, in the first step, a second peripheral edge part of the face plate p1 is made to abut on the receipt surface u1 so that the face plate p1 is disposed at the final position (see an arrow y2 of FIG. 13A).

Figure 14:
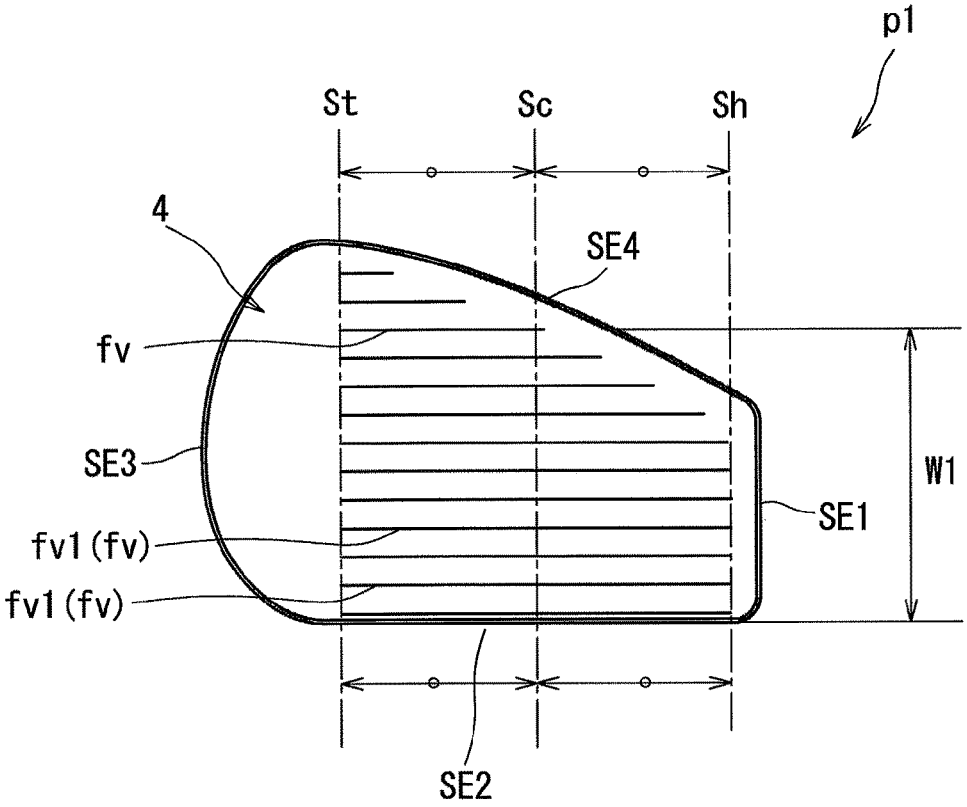
FIG. 14 is the same plan view as FIG. 5, and in FIG. 14, a score line is described.

FIG. 14 is a plan view of the face plate p1. A score line fv is drawn in FIG. 14. A plurality of score lines fv are formed in the face plate p1. The score lines fv include a longest score line fv1. The position of a toe side end of the longest score line fv1 is defined as a first position St. The position of a heel side end of the longest score line fv1 is defined as a second position Sh. A position bisecting a distance between the first position St and the second position Sh is defined as a line center position Sc. All of the first position St, the second position Sh, and the line center position Sc are positions in the toe-heel direction.

An up-down direction width W1 of the face plate p1 is gradually decreased as going to a heel side from a toe side in a range of from the first position St to the second position Sh.

The face plate p1 has a straight line edge part SE1. The straight line edge part SE1 is a heel side edge. The straight line edge part SE1 is positioned in the heel side region. The straight line edge part SE1 extends along a straight line. The straight line edge part SE1 extends along the up-down direction.

The face plate p1 has a straight line edge part SE2. The straight line edge part SE2 is a sole side edge. The straight line edge part SE2 is positioned in the sole side region. The straight line edge part SE2 extends along a straight line. The straight line edge part SE2 extends along the toe-heel direction.

The face plate p1 has a curve line edge part SE3. The curve line edge part SE3 is a toe side edge. The curve line edge part SE3 is positioned in the toe side region. The curve line edge part SE3 extends along a convex curve line. The convex curve line is curved so as to project toward an outer direction of a face.

The face plate p1 has a curve line edge part SE4. The curve line edge part SE4 is a top side edge. The curve line edge part SE4 is positioned in the top side region. The curve line edge part SE4 extends along a convex curve line. The convex curve line is curved so as to project toward the outer direction of the face.

Figure 15:
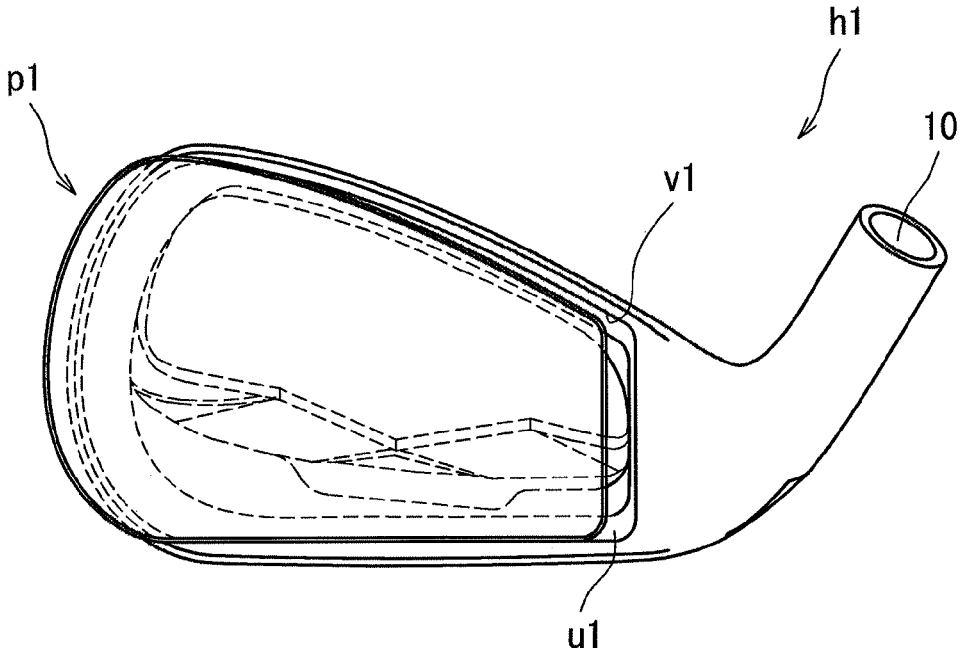
FIG. 15 is a front view showing a state where a face plate is displaced to a toe side with respect to a head body.

FIG. 15 shows the states of the head body h1 and the face plate p1 in the first step. The sectional view corresponding to FIG. 15 is FIG. 13A. FIG. 15 shows a state just before the insertion in the first step is conducted.

In the first step, the face plate p1 is moved to the final position from a position (state of FIG. 15) in which it is displaced to the toe side with respect to the final position. As described above, the up-down direction width W1 of the face plate p1 is gradually decreased as it goes to the heel side from the toe side. For this reason, the outer edge of the face plate p1 may be positioned inside the contour (body side surface v1) of the face opening 14 in a state where the face plate p1 is displaced to the toe side with respect to the final position. That is, the face opening 14 is less likely to interfere with the face plate p1. For this reason, the first step is likely to be smoothly conducted.

Figure 16:
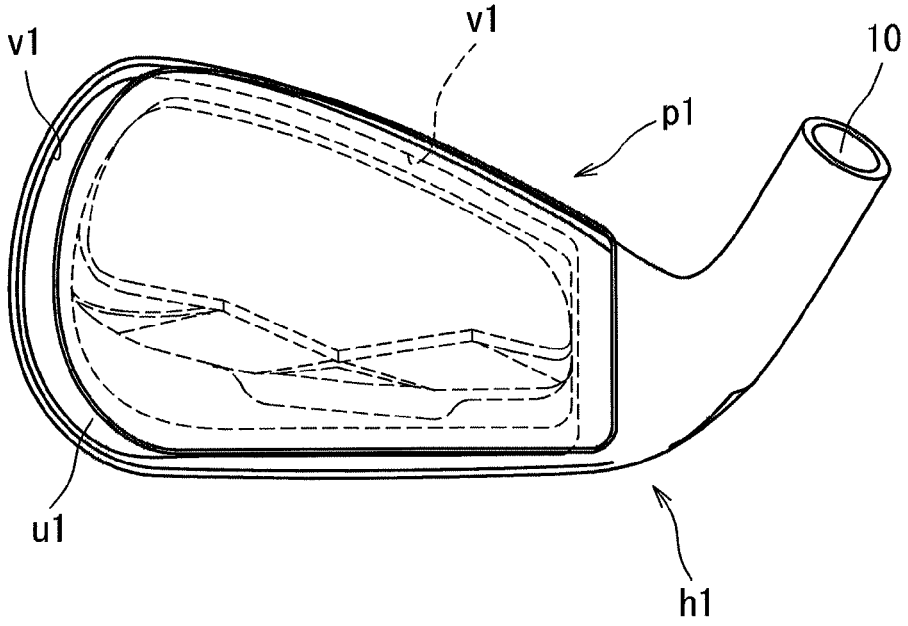
FIG. 16 is a front view showing a state where a face plate is displaced to a heel side with respect to a head body.

Meanwhile, for example, a case where the face plate p1 is displaced to the heel side with respect to the final position is considered. FIG. 16 shows a state where the face plate p1 is displaced to the heel side with respect to the final position. When the engaging part E1 is provided on the toe side, the first step goes through the state of FIG. 16. In this case, a large portion of the edge of the face plate p1 is positioned outside the face opening 14. That is, the face opening 14 is apt to interfere with the face plate p1. Particularly, the face opening 14 is apt to interfere with the face plate p1 in a toe side portion close to the engaging part E1. Therefore, until just before the face plate p1 is inserted into the engaging part E1, the face opening 14 interferes with the face plate p1. For this reason, the first step is less likely to be smoothly conducted.

In the present embodiment, the engaging part E1 is provided on the heel side. Therefore, as shown in FIG. 15, the first step may be smoothly conducted. From this viewpoint, the non-plastically deformed part n1 is preferably provided in only the heel side region.

Figure 17:
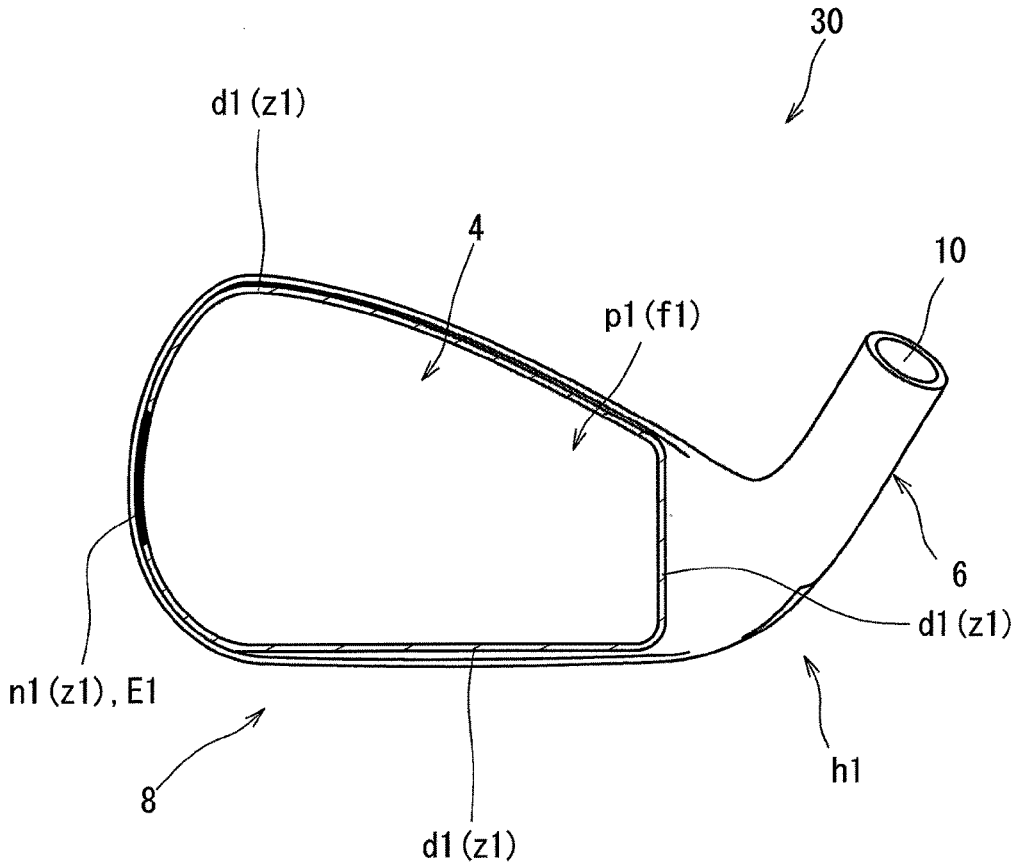
FIG. 17 is a front view of a head of a second embodiment, and in FIG. 17, a non-plastically deformed part is shown by a thick line (solid black), and a plastically deformed part is shown by hatching.

FIG. 17 is a front view of a head 30 according to a second embodiment. Except for the positions of a non-plastically deformed part n1 and a plastically deformed part d1, the head 30 is the same as the head 2. As with FIG. 10, also in FIG. 17, the non-plastically deformed part n1 is shown by a thick line, and the plastically deformed part d1 is shown by hatching. In the head 30, the non-plastically deformed part n1 is provided in a toe side region. The non-plastically deformed part n1 is provided in only the toe side region.

In the head 30, the non-plastically deformed part n1 and the plastically deformed part d1 are provided in the toe side region. The plastically deformed part d1 is provided in a heel side region, and the non-plastically deformed part n1 is not provided in the heel side region. The plastically deformed part d1 is provided in a top side region, and the non-plastically deformed part n1 is not provided in the top side region. The plastically deformed part d1 is provided in a sole side region, and the non-plastically deformed part n1 is not provided in the sole side region.

Figure 18:
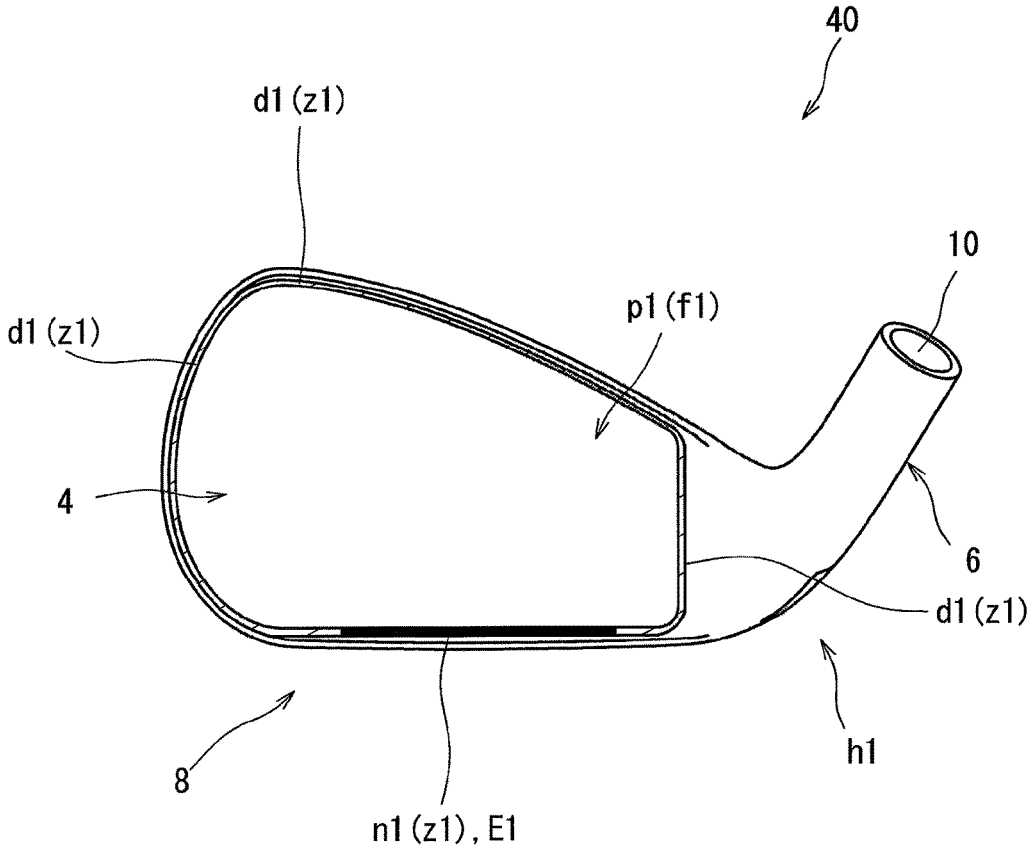
FIG. 18 is a front view of a head of a third embodiment, and in FIG. 18, a non-plastically deformed part is shown by a thick line (solid black), and a plastically deformed part is shown by hatching.

FIG. 18 is a front view of a head 40 according to a third embodiment. Except for the positions of a non-plastically deformed part n1 and a plastically deformed part d1, the head 40 is the same as the head 2. As with FIG. 10, also in FIG. 18, the non-plastically deformed part n1 is shown by a thick line, and the plastically deformed part d1 is shown by hatching. In the head 40, the non-plastically deformed part n1 is provided in a sole side region. The non-plastically deformed part n1 is provided in only the sole side region.

In the head 40, the non-plastically deformed part n1 and the plastically deformed part d1 are provided in the sole side region. The plastically deformed part d1 is provided in a heel side region, and the non-plastically deformed part n1 is not provided in the heel side region. The plastically deformed part d1 is provided in a top side region, and the non-plastically deformed part n1 is not provided in the top side region. The plastically deformed part d1 is provided in a toe side region, and the non-plastically deformed part n1 is not provided in the toe side region.

An iron is most commonly used when hitting a golf ball placed on grass. For this reason, in an iron head, a hit point is apt to be concentrated closer to the sole. When the non-plastically deformed part n1 is provided on the sole side, the non-plastically deformed part n1 having excellent strength is disposed close to the hit point. From the viewpoint of strength, the non-plastically deformed part n1 is preferably provided in the sole side region.

Figure 19:
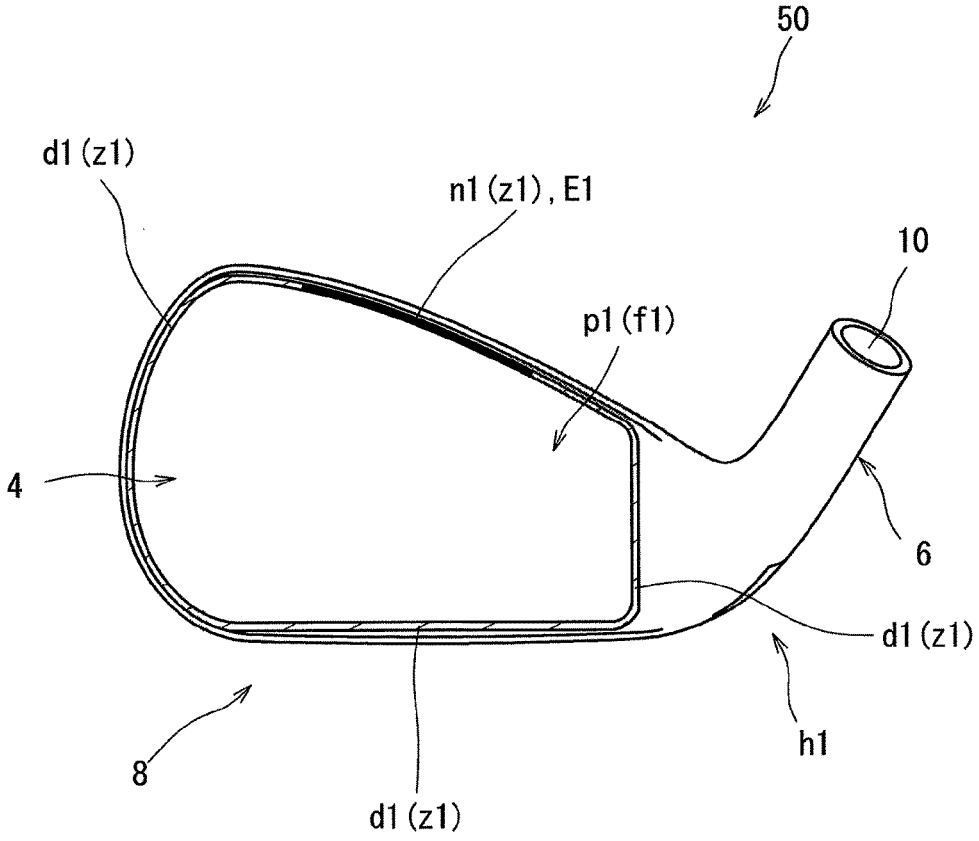
FIG. 19 is a front view of a head of a fourth embodiment, and in FIG. 19, a non-plastically deformed part is shown by a thick line (solid black), and a plastically deformed part is shown by hatching.

FIG. 19 is a front view of a head 50 according to a fourth embodiment. Except for the positions of a non-plastically deformed part n1 and a plastically deformed part d1, the head 50 is the same as the head 2. As with FIG. 10, also in FIG. 19, the non-plastically deformed part n1 is shown by a thick line, and the plastically deformed part d1 is shown by hatching. In the head 50, the non-plastically deformed part n1 is provided in a top side region.

In the head 50, the non-plastically deformed part n1 and the plastically deformed part d1 are provided in the top side region. The plastically deformed part d1 is provided in a heel side region, and the non-plastically deformed part n1 is not provided in the heel side region. The plastically deformed part d1 is provided in a toe side region, and the non-plastically deformed part n1 is not provided in the toe side region. The plastically deformed part d1 is provided in a sole side region, and the non-plastically deformed part n1 is not provided in the sole side region.

As shown in the first to fourth embodiments (FIGS. 10, 17, 18, and 19), the position of the non-plastically deformed part n1 (engaging part E1) is not limited. In light of the smoothing properties of the first step, the non-plastically deformed part n1 (engaging part E1) is preferably disposed in only one region selected from the group consisting of the toe side region, the heel side region, the top side region, and the sole side region.

In the first to fourth embodiments (FIGS. 10, 17, 18, and 19), the number of the non-plastically deformed parts n1 (engaging parts E1) is 1. Meanwhile, a plurality of non-plastically deformed parts n1 (engaging parts E1) may be provided. For example, the non-plastically deformed parts n1 (engaging parts E1) may be provided at a plurality of places in the heel side region. The non-plastically deformed parts n1 (engaging parts E1) may be provided at a plurality of places in the toe side region. The non-plastically deformed parts n1 (engaging parts E1) may be provided at a plurality of places in the top side region. The non-plastically deformed parts n1 (engaging parts E1) may be provided at a plurality of places in the sole side region.

In the head 2 of the first embodiment (FIG. 10), the non-plastically deformed part n1 (engaging part E1) extends along a straight line. The straight line edge part SE1 is inserted into the engaging part E1 extending along the straight line. For this reason, the first step is likely to be smoothly performed. The engaging part E1 extending along the straight line is easily formed. On that point, the head 40 of the third embodiment (FIG. 18) is also the same.

In the head 30 of the second embodiment (FIG. 17), the non-plastically deformed part n1 (engaging part E1) extends curvedly so as to project toward the outer direction of the face. The curve line edge part SE3 is inserted into the engaging part E1 extending curvedly. The insertion of the curve line edge part SE3 is not smoother than the insertion of the first embodiment under the influence of the curve. In addition, as shown in FIG. 16, the insertion of the curve line edge part SE3 to the engaging part E1 positioned in the toe side region is not smooth. However, to put it the other way around, if the curve line edge part SE3 is inserted once, the curve line edge part SE3 is less likely to come off from the engaging part E1. The difficulty of coming off can contribute to the certainty of the fixation of the face plate p1. On that point, the head 50 of the fourth embodiment (FIG. 19) is also the same.

The outer direction of the face is a direction toward the outer edge of the hitting face 4 from the centroid CF.

The maximum height of the face plate p1 is shown by a double-headed arrow Wf in FIG. 5. The height Wf is measured along the up-down direction. The height Wf is the maximum value of the above-mentioned up-down direction width W1. The peripheral length of the non-plastically deformed part n1 is defined as L2.

As described above, when the engaging part E1 is positioned in the toe side region, the face plate p1 is comparatively less likely to be inserted into the engaging part E1. When the non-plastically deformed part n1 (engaging part E1) is positioned in the toe side region from the viewpoint of facilitating the insertion, a ratio (L2/Wf) is preferably smaller. Specifically, L2/Wf is preferably equal to or less than 0.8, more preferably equal to or less than 0.7, and still more preferably equal to or less than 0.6. From the viewpoint of the fixed strength of the face plate p1, L2/Wf is preferably equal to or greater than 0.2, more preferably equal to or greater than 0.3, and still more preferably equal to or greater than 0.4.

When the undeformed projection d2 is provided in the toe side region, the undeformed projection d2 extends curvedly so as to project toward the outer direction of the face. If the curved undeformed projection d2 is subjected to the caulking step, the undeformed projection d2 is pushed down to the inside of the curve. Since the peripheral length of the inside of the curve is shorter than the peripheral length of the outside of the curve, a surplus volume is generated by pushing the undeformed projection d2 down to the inside of the curve. This is apt to cause the poor formation of the plastically deformed part d1. The poor formation is suppressed by providing the non-plastically deformed part n1 in at least a part of the toe side region. From this viewpoint, the non-plastically deformed part n1 preferably extends curvedly so as to project toward the outer direction of the face. The curvature radius of the curve is the smallest in the toe side region. Therefore, from the viewpoint of suppressing the poor formation, the non-plastically deformed part n1 is preferably provided in the toe side region.

[Heel Disposition Effect]

The head 2 of the first embodiment (FIG. 10) makes it possible to dispose the face plate p1 on the heel side. The effect is also referred to as a heel disposition effect.

As described above, in the caulking step, plane process is performed. In the plane process, the undeformed projection d2 is crushed by a pressing body having a plane. Therefore, in order to perform the plane process, the circumference of the undeformed projection d2 is required to be a plane. If the undeformed projection d2 is too close to the curved surface part 24, the curved surface part 24 interferes with the pressing body, which makes it impossible to perform the plane process. As a result, the face opening 14 is restrictedly brought close to the curved surface part 24. That is, the face plate p1 is restrictedly disposed on the heel side.

In the head 2 of the first embodiment (FIG. 10), the non-plastically deformed part n1 is provided on the heel side, and the plane process is unnecessary for the non-plastically deformed part n1. Therefore, the face opening 14 can be brought closer to the curved surface part 24. As a result, the distance between the face opening 14 and the curved surface part 24 can be decreased. That is, the face plate p1 can be disposed on a further heel side. The degree of freedom of design of the head is improved by the heel disposition effect.

The heel disposition effect provides a further effect. Generally, in an iron head, the weight percentage of a hosel is large, and a sweet spot is likely to be positioned on the heel side. For this reason, the sweet spot tends to be positioned on a heel side with respect to the center of a score line (the above mentioned line center position Sc). Since the face plate p1 moves to the heel side according to the above-mentioned heel disposition effect, the line center position Sc can be brought close to the position of the sweet spot.

A golfer attempts to hit a golf ball at the center of a score line. That is, the golfer tends to hit the golf ball at the line center position Sc. When the line center position Sc is brought close to the sweet spot, the golfer's hit point and the sweet spot are brought close to each other. Therefore, rebound performance in real hitting can be improved. In other words, an average flight distance in real hitting can be increased.

The heel disposition effect provides also a further another effect. As described above, in the iron head, the weight percentage of the hosel is large, and the sweet spot is likely to be positioned on the heel side. For this reason, the sweet spot SS tends to be positioned on the heel side with respect to the center of the face plate p1 (plate center). Since the face plate p1 moves to the heel side according to the above-mentioned heel disposition effect, the plate center can be brought close to the position of the sweet spot.

Flexural deformation in hitting is large at the plate center. The large flexural deformation improves the rebound performance. The plate center in which the flexural deformation is large is brought close to the sweet spot, which can provide an improvement in the rebound performance. The plate center is defined as the centroid of the face plate p1 in plan view.

A distance between a toe side end x1 of the non-plastically deformed part n1 and the boundary bd1 is shown by a double-headed arrow D1 in FIG. 12. The distance D1 is measured along the toe-heel direction. From the viewpoint of the above-mentioned heel disposition effect, the distance D1 is preferably equal to or less than 5 mm, more preferably equal to or less than 4 mm, and still more preferably equal to or less than 3.5 mm. The distance D1 may be 0 mm. When the distance between the end x1 and the boundary bd1 changes, the minimum value of the distance is defined as the distance D1.

The non-plastically deformed part n1 is not plastically deformed. Therefore, the non-plastically deformed part n1 has more excellent strength than the strength of the plastically deformed part d1. For this reason, the non-plastically deformed part n1 is provided, which can provide an increase in the fixed strength of the face plate p1 as compared with the case of only the caulking part.

The caulking step may cause the poor formation of the plastically deformed part d1. Therefore, variation may occur in the fixed strength in the plastically deformed part d1. Meanwhile, in the non-plastically deformed part n1, the poor formation caused by the caulking step does not occur. Stable fixed strength can be obtained by providing the non-plastically deformed part n1.

In the case of the caulking step, the plastically deformed part d1 is formed by the plastic deformation. Therefore, the dimension of the plastically deformed part d1 is largely restricted. Meanwhile, the dimension of the non-plastically deformed part n1 does not have a restriction caused by the plastic deformation, the non-plastically deformed part n1 has an excellent degree of freedom of design. Therefore, for example, the depth of the engaging part E1 has a comparatively high degree of freedom of design. The engaging part E1 contributes to an improvement in the degree of freedom of design.

In the present application, the peripheral length of the front disposition part z1 is defined as L1. The peripheral length L1 is a length of an outermost contour line in plan view as shown in FIG. 10. The peripheral length of the non-plastically deformed part n1 is defined as L2. The peripheral length L2 is a length of an outermost contour line in plan view as shown in FIG. 10.

From the viewpoint of increasing the fixed strength of the face plate p1, L2/L1 is preferably equal to or greater than 0.06, more preferably equal to or greater than 0.09, and still more preferably equal to or greater than 0.12. From the viewpoint of facilitating the insertion in the first step, L2/L1 is preferably equal to or less than 0.30, more preferably equal to or less than 0.27, and still more preferably equal to or less than 0.24.

The width of the plastically deformed part d1 is shown by a double-headed arrow Wd1 in FIG. 12. The width Wd1 is also a width Wz1 of the front disposition part z1. The width of the non-plastically deformed part n1 is shown by a double-headed arrow Wn1 in FIG. 12. The width Wn1 is also a width Wz1 of the front disposition part z1.

The width Wn1 of the non-plastically deformed part n1 may be constant, or may change. The width Wd1 of the plastically deformed part d1 may be constant, or may change. In light of productivity, the width Wn1 of the non-plastically deformed part n1 is preferably constant. In light of productivity, the width Wd1 of the plastically deformed part d1 is preferably constant. Preferably the width Wd1 and the width Wn1 are made to be the same, and the width Wd1 and the width Wn1 are made to be constant. In other words, the width Wz1 of the front disposition part z1 is made to be constant.

The width Wd1 and the width Wn1 may be different from each other. For example, the width Wn1 can be made to be greater than the width Wd1. For example, the width Wn1 can be made to be smaller than the width Wd1.

EXAMPLES

Hereinafter, the effects of the present embodiments will be clarified by Examples. However, the present embodiments should not be interpreted in a limited way based on the description of Examples.

Example 1

The same head as the above-mentioned head 2 was produced. A face plate p1 and a head body (undeformed body) h1*p* were prepared. The head body hip was produced by casting. A weight member wt was attached to a sole part of the head body h1*p*. The weight member wt was made of a tungsten nickel alloy. The head body hip included an undeformed projection d2. The undeformed projection d2 was formed in a part of the circumference of a face opening 14. The head body h1*p* was made of stainless steel (SUS630). The face plate p1 was cut from a plate material (rolling material). An outer peripheral edge part 16 which was a protruded part was produced by NC process. Furthermore, a step surface t1 was produced by NC process. The face plate p1 was made of a titanium alloy. As the titanium alloy, Super-TIX (registered trademark) manufactured by Nippon Steel & Sumitomo Metal Corporation was used.

An engaging part E1 was formed in a portion in which the undeformed projection d2 was not formed in the circumference of the face opening 14. Specifically, a body side surface v1 was cut by NC process, to form a recess. As a result, a receipt surface u1 was enlarged and a non-plastically deformed part n1 was formed at a position which was opposed to the enlarged receipt surface u1. In other words, by the recess, a clearance gp between the non-plastically deformed part n1 and the receipt surface u1 was formed. The clearance gp is the above-mentioned engaging part E1. In this Example, the non-plastically deformed part n1 was produced by casting and cutting (NC process).

Next, the above-mentioned plate attaching step was performed to fix the face plate p1 to the head body h1*p*. Specifically, the face plate P1 was disposed at a final position in the face opening 14 while inserting a portion in which the step surface t1 was formed in the face plate P1 into the engaging part E1 (first step). Then, the undeformed projection d2 was plastically deformed by performing the caulking step, to form a plastically deformed part d1 positioned at a front of the step surface t1 (second step). Thus, the head of Example 1 was obtained. Since the engaging part E1 was provided in a heel side region, the first step was smooth. Since the non-plastically deformed part n1 was provided in addition to the plastically deformed part d1, the head in which the fixed strength of the face plate p1 was excellent was obtained.

As described above, the advantages of the present embodiments are apparent.

The present embodiments can be applied to all golf club heads such as a wood type head, a utility type head, a hybrid type head, an iron type head, and a putter head.

The description hereinabove is merely for an illustrative example, and various modifications can be made in the scope not to depart from the principles of the present embodiments.

What is claimed is:

1. A golf club head comprising:

a head body; and a face plate fixed to the head body, wherein:

the face plate includes a plate front surface having a hitting face, and a plate back surface which is a surface opposite to the plate front surface;

the plate front surface has, on a peripheral edge part thereof, a step surface positioned at a rear with respect to the hitting face;

the head body has a receipt surface positioned at a rear of the plate back surface, a front disposition part positioned at a front of the step surface, and a hosel;

the front disposition part includes a plastically deformed part and a non-plastically deformed part; and a clearance between the non-plastically deformed part and the receipt surface forms an engaging part engaging the peripheral edge part of the face plate, wherein, a peripheral length of the front disposition part is defined as L1 and a peripheral length of the non-plastically deformed part is defined as L2, L2/L1 is 0.06 or greater but 0.30 or less.

2. The golf club head according to claim 1, wherein:

the front disposition part is provided in each of a toe side region, a heel side region, a top side region, and a sole side region; and the non-plastically deformed part is provided in only the heel side region.

3. The golf club head according to claim 2, wherein:

the head body includes a plane part constituting a part of the hitting face;

a curved surface part connecting the plane part and the hosel, and a boundary between the plane part and the curved surface part; and a toe-heel direction distance D1 between a toe side end of the non-plastically deformed part and the boundary is equal to or less than 5 mm.

4. The golf club head according to claim 2, wherein:

the face plate has a plurality of score lines;

the score lines include a longest score line; and a position of a toe side end of the longest score line is defined as a first position, and a position of a heel side end of the longest score line is defined as a second position, an up-down direction width W1 of the face plate is gradually decreased as going to a heel side from a toe side in a range of from the first position to the second position.

5. The golf club head according to claim 1, wherein:

the front disposition part is provided in each of a toe side region, a heel side region, a top side region, and a sole side region; and the non-plastically deformed part is provided in only the toe side region.

6. The golf club head according to claim 1, wherein:

the front disposition part is provided in each of a toe side region, a heel side region, a top side region, and a sole side region; and the non-plastically deformed part is provided in only the sole side region.

7. The golf club head according to claim 1, wherein the non-plastically deformed part is disposed in only one region selected from the group consisting of a toe side region, a heel side region, a top side region, and a sole side region.

8. The golf club head according to claim 1, wherein the non-plastically deformed part extends along a straight line.

9. The golf club head according to claim 1, wherein the non-plastically deformed part extends curvedly so as to project toward an outer direction of a face.

10. The golf club head according to claim 1, wherein the non-plastically deformed part has a constant width.

11. A method for manufacturing a golf club head, the method comprising:

a step of preparing a head body having a face opening, and a face plate; and a plate attaching step of attaching the face plate to the face opening, wherein:

the face plate includes a plate front surface having a hitting face, and a plate back surface which is a surface opposite to the plate front surface;

the plate front surface has, on a peripheral edge part thereof, a step surface positioned at a rear with respect to the hitting face;

the head body includes:

a receipt surface positioned at a rear of the face opening;

an undeformed projection provided along an outer edge of the face opening;

a non-plastically deformed part disposed to be opposed to the receipt surface; and an engaging part formed by a clearance between the non-plastically deformed part and the receipt surface, the plate attaching step includes:

a first step of disposing the face plate at a final position in the face opening while inserting a portion in which the step surface is formed in the face plate into the engaging part of the head body; and a second step of plastically deforming the undeformed projection to form a plastically deformed part positioned at a front of the step surface, wherein, a peripheral length of a front disposition part including the non-plastically deformed part and the plastically deformed part is defined as L1 and a peripheral length of the non-plastically deformed part is defined as L2, L2/L1 is 0.06 or greater but 0.30 or less.

12. A golf club head comprising:

a head body; and a face plate fixed to the head body, wherein the face plate includes a plate front surface having a hitting face, and a plate back surface which is a surface opposite to the plate front surface, wherein the plate front surface has, on a peripheral edge part thereof, a step surface positioned at a rear with respect to the hitting face, wherein the head body has a receipt surface positioned at a rear of the plate back surface, a front disposition part positioned at a front of the step surface, and a hosel, wherein the front disposition part includes a plastically deformed part and a non-plastically deformed part, wherein a clearance between the non-plastically deformed part and the receipt surface forms an engaging part engaging the peripheral edge part of the face plate, wherein the front disposition part is provided in each of a toe side region, a heel side region, a top side region, and a sole side region, wherein the non-plastically deformed part is provided in only the heel side region, wherein the head body includes a plane part constituting a part of the hitting face, a curved surface part connecting the plane part and the hosel, and a boundary between the plane part and the curved surface part, and wherein a toe-heel direction distance D1 between a toe side end of the non-plastically deformed part and the boundary is equal to or less than 5 mm.

* * * * *